US006199483B1

(12) United States Patent
Barbiche

(10) Patent No.: US 6,199,483 B1
(45) Date of Patent: Mar. 13, 2001

(54) OPTOPYROTECHNIC DEMOLITION INSTALLATION

(75) Inventor: Robert Patrick Barbiche, Hoenheim (FR)

(73) Assignee: Cardem Demolition S.A., Bischheim Cedex (FR)

( * ) Notice: Subject to any disclaimer, the term of this patent is extended or adjusted under 35 U.S.C. 154(b) by 0 days.

(21) Appl. No.: 09/222,085

(22) Filed: Dec. 29, 1998

(30) Foreign Application Priority Data

Jan. 7, 1998 (FR) ..... 98 00084

(51) Int. Cl.[7] ..... F42B 3/113; F42B 3/10
(52) U.S. Cl. ..... 102/201; 102/201
(58) Field of Search ..... 102/201

(56) References Cited

U.S. PATENT DOCUMENTS

| | | | | |
|---|---|---|---|---|
| 3,618,526 | * | 11/1971 | Baker | 102/70.2 |
| 3,812,783 | * | 5/1974 | Yang et al. | 102/70.2 |
| 4,391,195 | | 7/1983 | Shann | 102/201 |
| 4,917,014 | * | 4/1990 | Loughry et al. | 102/201 |
| 5,031,187 | | 7/1991 | Orenstein et al. | 372/50 |
| 5,138,946 | * | 8/1992 | Soltz et al. | 102/201 |
| 5,204,490 | * | 4/1993 | Soltz et al. | 102/201 |
| 5,206,455 | | 4/1993 | Williams et al. | 102/201 |
| 5,756,924 | * | 5/1998 | Early | 102/201 |

FOREIGN PATENT DOCUMENTS

| | | | |
|---|---|---|---|
| 2 055 930 | * | 3/1981 | (GB) . |
| 2 063 964 | * | 6/1981 | (GB) . |

* cited by examiner

*Primary Examiner*—Michael J. Carone
*Assistant Examiner*—Lucit Semunegus
(74) *Attorney, Agent, or Firm*—Oblon, Spivak, McClelland, Maier & Neustadt, P.C.

(57) ABSTRACT

An installation formed of several independent groups is proposed to demolish structures such as buildings, bridges, materials, etc., in particular eliminating any risk of accidental firing. Each group comprises a control unit (10) with several outputs (18) including at least one laser source (16), pyrotechnic initiators (12) with optical control, and optical fibers (14) connecting the outputs (18) of the control unit (10) to the initiators (12). Laser sources (16) may be either laser diodes, or sources with a pumped solid rod operating in relaxed mode.

9 Claims, 4 Drawing Sheets

OPTOPYROTECHNIC DEMOLITION INSTALLATION

BACKGROUND OF THE INVENTION

1. Field of the Invention

The present invention concerns an installation designed for demolition or destruction of constructions, such as buildings, industrial buildings, bridges, rock and in general, any natural structure or constructed structure (buildings, public works, underground works, quarries, etc.) wherein the demolition of destruction of the constructions is accomplished using explosives.

2. Discussion of Background

When constructions, bridges, materials, etc., are destroyed using explosives, a large number of small explosive charges are placed in holes drilled in the structures of the works to be demolished.

At the present time, these small charges are primed by medium or high intensity electrical detonators that are electrically fired by means of firing apparatus.

More precisely, in order to limit nuisances such as vibrations, blast, noise, etc., the global explosion is broken down into a multitude of small explosions which occur at specific time intervals.

Electric detonators with micro-delays are usually used for this purpose and are grouped in series (for example twenty units). A time interval (for example 25 thousandths of a second) is provided between each detonator in the same series.

Sequential type exploders are also usually used, in which several lines of detonators are fired at time intervals. Several sequential firing apparatuses may then be coupled.

When designed to demolish a residential building, existing installations operating according to the above stated principle comprise 1500 to 2000 detonators for each firing. Firing may last for 3 to 4 seconds, due to the spacing of explosion initiated by the installation. This firing takes place after preliminary work to install charges and primers which may last for 3 to 4 days, or even a week.

With current installations, accidental priming or failures may occur throughout the duration of the prior work to install charges and primers.

The main risk of accidental ignition is due to stray currents that may occur around primed charges. These stray currents may originate from a number of causes, such as lightning, currents originating from overhead or underground electrical networks, currents originating from nearby electrical installations in operation (electrical transformers, e.g., railway or tramway catenary lines, lights, etc.), and natural currents circulating underground when boring tunnels.

Charges may also be fired accidentally due to the use of electronic devices, such as radios, walkie-talkies, portable telephones, etc., in the vicinity of these charges.

Accidental firing of the detonators may also occur during transport or during storage, for example, due to stray currents or accidents of various types.

Since the drilling work may last for 3 or 4 days or even a week, there is also a risk that the previously installed charges may be fired mischievously by means of a simple electric battery.

Furthermore, when the construction to be demolished concerns the nuclear industry, as is particularly the case for demolition of a nuclear power station, existing demolition installations cannot be used at the time of firing due to disturbances that exist in an intense radioactive environment.

Existing electrically fired demolition installations are also affected by failures that can affect the demolition work. One particular cause of these failures is broken electric wires or wires in contact with metal structures, such as protective grills, metal equipment in buildings to be demolished, etc. When the construction to be demolished is a large metal structure, such as a thermal power station, failures may also be caused by electric fields produced by the enormous mass of steel in the building.

Furthermore, electric detonators used in existing demolition installations may be stolen and easily reused, both during their transport or storage, and after being installed in the construction to be demolished.

Finally, note that when there are any problems in the circuits of this type of demolition installation, these problems are frequently very long and dangerous to detect. It is easy to find out which line is defective, but it is impossible to know the exact location of the break in the circuit.

SUMMARY OF THE INVENTION

The purpose of the present invention is a demolition installation, the original design of which enables it to eliminate all disadvantages of existing electrically controlled installations, and in particular, eliminates all risks of accidental or mischievous firing both during work to install charges and priming operations, and during prior storage and transport of components of the installation.

According to the present invention, this result is obtained by means of a demolition installation characterized by the fact that it comprises at least two independent groups, each including:

- a control unit with several outputs, each comprising at least one laser source and at least one control switch for the said laser source, in which closure will cause the laser source to emit a laser beam at one or more of the said outputs;
- optically controlled pyrotechnic initiators placed at determined locations in the structure to be demolished; and
- optical fibers connecting each of the pyrotechnic initiators to one of the outputs of the control unit.

In an installation designed in this way, pyrotechnic initiators are only fired optically through the optical fibers. Therefore, firing is absolutely independent of stray currents. This procures optimum safety, particularly when the construction to be demolished is located in or close to electrical substations or under catenary lines. Furthermore, stormy weather has no influence on the work progress or safety.

The characteristic mentioned above also means that constructions located in large urban centers can be demolished at no risk, despite the large amount of electronic equipment present in these centers.

Furthermore, firing triggered by mischievous persons is impossible, since these persons would need a laser and the laser will have to be compatible with the precise frequency of the laser used in the installation.

Since firing is controlled optically, ignition cannot be disturbed by any metal mass. Safety during transport and during storage of components is also guaranteed.

Furthermore, optically controlled detonators cannot be used if they are stolen.

Finally, a computer can easily be used to determine the location of a break in the optical fibers.

In a first embodiment of the present invention, the laser sources are sources with a pumped solid rod operating in relaxed mode. Each control unit then comprises a single laser source and an optical divider coupler with an input that can receive the laser beam emitted by the laser source and several outputs forming control unit outputs.

Some or all of the optical fibers in each group then connect several pyrotechnic initiators to one of the outputs of the control unit through at least one second optical divider coupler.

Advantageously, each control unit comprises a secondary input and feedback means capable of aiming an additional laser beam penetrating into the control unit through its secondary input, towards the input of the optical divider coupler. A supplementary laser source common to all groups is then provided, so that the supplementary laser beam can be emitted whenever necessary following a failure of the laser source in one of the control units.

Each control unit may thus include an auxiliary control input and second feedback means capable of setting up a bypass optical path between the auxiliary input of the control and the input of the optical divider coupler for this control unit. In particular, this arrangement means that the integrity of optical fibers can be checked using a visible light source placed in front of the auxiliary control input.

Each control unit preferably comprises a retractable shutter that may be placed between the laser source and the input of the optical divider coupler.

The second feedback means are formed on this retractable shutter when it occupies an active shutter position.

Each control unit may also include a safety switch mounted in series with the laser source control switch.

In a second embodiment of the present invention, the laser sources are laser diodes. Each control unit then includes one laser diode for each output, and each laser diode is optically connected to one of these outputs.

In this second embodiment of the present invention, each laser diode may be installed in series with a distinct control switch in each of the control units. In this case, a common safety switch is installed in series with all laser diodes in each control unit.

As a variant, laser diodes in each of the control units form a matrix containing n rows and m columns, the laser diodes in each row being installed in series with a first control switch and the laser diode outputs in each column being connected to a second control switch.

BRIEF DESCRIPTION OF THE DRAWING FIGURES

We will now describe various embodiments of the present invention using non-restrictive examples, with reference to the attached drawings in which:

FIG. 1 diagrammatically shows an installation for demolition of constructions, illustrating a first embodiment of the present invention;

FIG. 2 diagrammatically shows the constituents of one of the control blocks of the installation in FIG. 1;

DETAILED DESCRIPTION OF THE PREFERRED EMBODIMENTS

Figure 1:
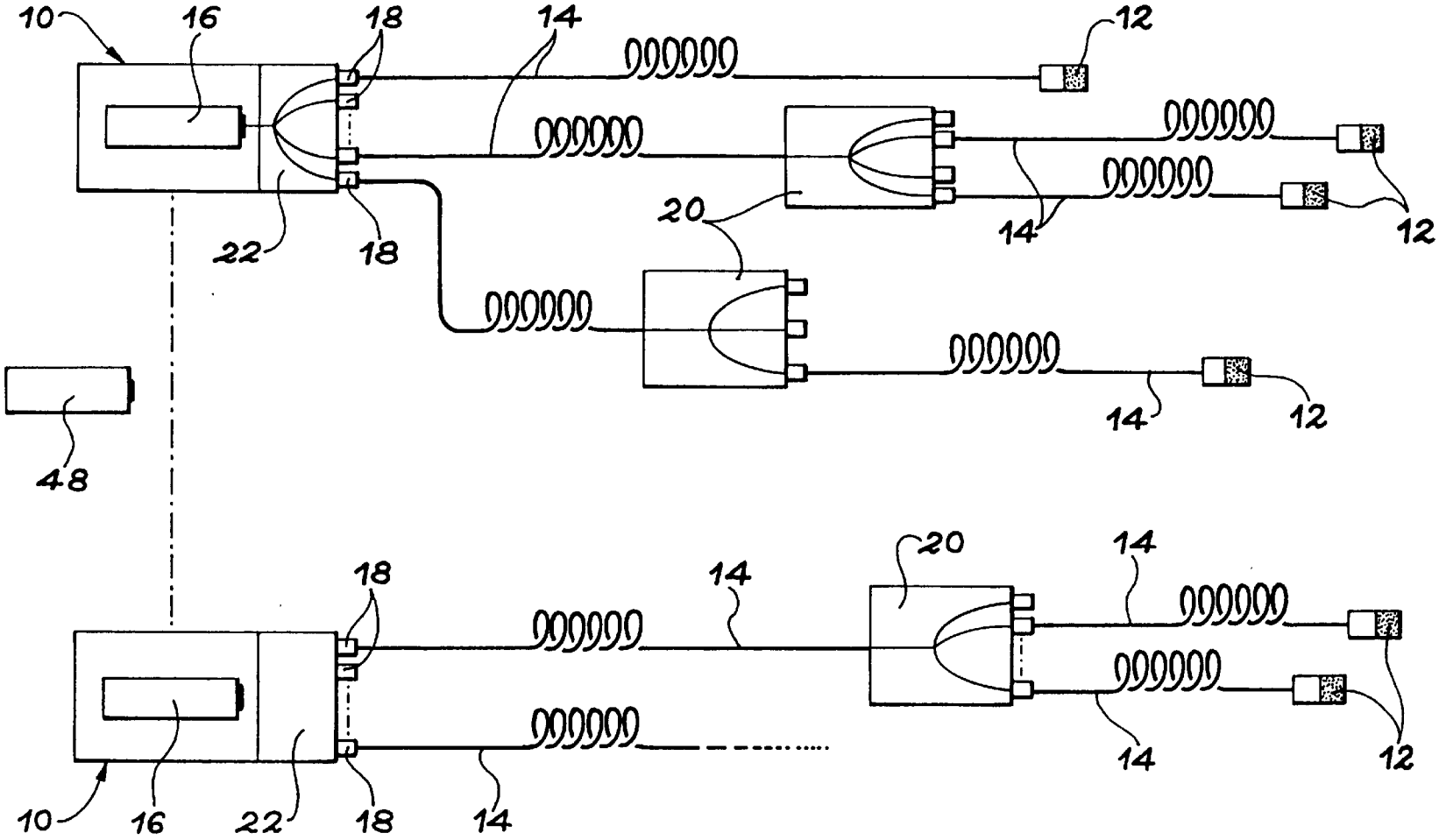
Figure 2:
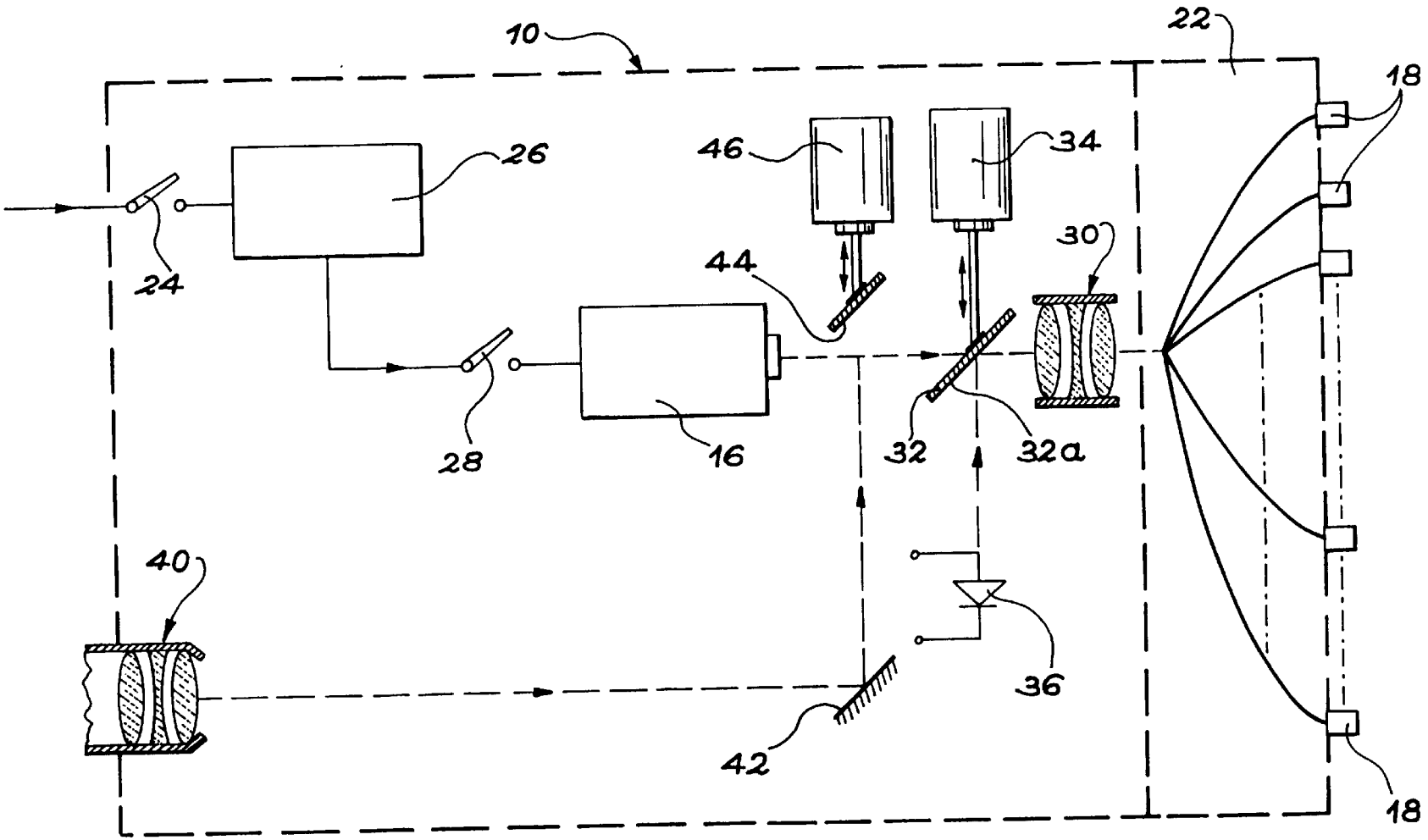

In the first embodiment of the present invention illustrated in FIGS. 1 and 2, the demolition installation comprises several completely independent groups. However, each of the several independent groups includes a control unit 10, a number of pyrotechnic initiators 12 with optical control, and optical fibers 14 each connecting pyrotechnic initiators 12 to one of the outputs 18 from the control unit 10 of the corresponding unit.

FIG. 1 only shows two independent groups in a demolition installation according to the present invention. In practice, the number of independent groups in the installation is not limited and may be any number greater than or equal to 2. By convention, the number of independent groups in the installation will be denoted K.

Each control unit 10 in this case comprises a single laser source 16, composed of a laser source with a pumped solid rod operating in a relaxed mode. In other words, without triggering using, Pockets cells or any other similar means. The characteristics of this type of laser source are such that a relatively long pulse stream (about 150 $\mu$s) is capable of outputting an instantaneous power on the order of several tens of optical kilowatts.

This power level of laser sources 16 makes it possible to divide the laser beam, successively inside each control unit 10, and then possibly beyond this control unit.

Inside each of the control units 10 as illustrated more precisely in FIG. 2, the laser beam is divided by a first optical divider coupler 22. This first optical divider coupler 22 has a single input located on the optical path of the laser source 16, which receives the laser beam sent by this source. The optical divider coupler 22 also includes N outputs forming the outputs 18 from control unit 10.

In practice, the number of outputs 18 in each control unit 10 is between, for example, four and twelve. Note that the number of outputs 18 from control units 10 in each group may be identical or different in different groups, without going outside the scope of the invention.

As shown diagrammatically but only partially in FIG. 1, the optical fibers 14 are used to connect each output 18 from control unit 10 depending on the case, with one or several pyrotechnic initiators 12 for the group considered.

Thus, the top of FIG. 1 shows the case of a pyrotechnic initiator 12 in which the optical input is directly connected to one of the outputs 18 of the corresponding control unit 10 through an optical fiber 14, without any device having been placed on the path of the optical fiber.

On the other hand, all other links shown between the outputs of the control unit 10 and the optical inputs of the pyrotechnic initiators 12 are designed to connect several pyrotechnic initiators 12 to the same output 18. Consequently, second optical divider couplers 20 are placed between the outputs 18 concerned and the initiators 12 that will be connected to these outputs.

More precisely, each of the second optical divider couplers 20 has a single input which is connected to one of the outputs 18 from the corresponding control unit 10 through a first optical fiber 14 and several outputs, each of which is connected to one of the pyrotechnic initiators 12 through a corresponding optical fiber 14.

The second optical divider couplers 20 used in the installation may all be identical or may be of different types. Their number of outputs may be, for example, between 4 and 12.

When choosing the number of outputs in the divider couplers 22 and 20, care must be taken to ensure that the power and the energy transferred to each pyrotechnic initiator 12 is sufficient for firing. The power and energy transferred depend on the characteristics of the laser source 16 contained in the control unit 10 and the total attenuation resulting from putting several divider couplers in cascade on the channel(s) considered.

This observation is confirmed by the approximate expression of the power PD (in $dB_\omega$) available for any initiator 12, which is given by the following formula in the case of a group comprising a control unit with N outputs 18 and a second optical divider coupler 20 with M outputs inserted between one of the outputs of the control unit 10 and the pyrotechnic initiator 12 considered $$PD = PS + 10\log\frac{1}{N} + 10\log\frac{1}{M} + \sum,$$

where

PS is the power output by the laser source (in $dB_\omega$) and

Σ is the sum of losses due to the optical link and optical couplers.

The pyrotechnic initiators 12 are optically controlled detonators, capable of controlling priming of explosive charges placed in holes drilled in the structure to be demolished. Detonators with optical control may be made, depending on the case, either using detonators with conventional delays to which an optical input is adapted, or by using existent opto-detonators designed for the space industry, like those, for example, that are described in documents FR-A-2 615 609 and FR-A-2 646 901.

In the architecture of the demolition installation designed in this way, all initiators in the same group are fired simultaneously. On the other hand, independence between groups means that each can be controlled separately with programmed delays. Similarly, it is thus possible to make pyrotechnic initiators redundant by placing initiators belonging to different groups in nearby locations.

As illustrated more precisely in FIG. 2, each control unit 10 comprises an electric power supply circuit for the laser source 16. This electric power supply circuit comprises a safety switch 24, a low voltage/high voltage converter 26, and a control switch 28 for the laser source 16, in series between an input connector that may be connected to an external source (not shown) and the laser source 16. When this power supply circuit is connected to the external electric power supply source, each of the switches 24 and 28 must be closed before the laser source 16 can be used.

The laser beam emitted by the laser source 16, when used, is transmitted to the input of the optical divider coupler 22 through an adapter lens 30.

On the input side of the adapter lens 30, a retractable shutter 32 is placed on the optical path between laser source 16 at the input of the optical divider coupler 22. This retractable shutter 32 is controlled by a motor 34 that moves it between a passive retracted position in which the shutter 32 is not placed on the optical path mentioned above, and an active shutter position shown in FIG. 2, in which the shutter is placed on this optical path.

The retractable shutter 32 and the safety switch 24 form two safety devices eliminating any risk of accidental firing following accidental closure of the control switch 28.

As diagrammatically illustrated in FIG. 2, the retractable shutter 32 has an inclined reflecting face 32*a* facing the adapter lens 30 when the shutter occupies its active closing position. This inclined reflecting face 32*a* of the retractable shutter 32 is one means of feedback that can direct a light beam penetrating into the control unit 10 to the input of the optical divider coupler 22, through an auxiliary control input (not shown) or on the other hand, by directing a light beam from one or several lines formed by optical fibers 14, to this auxiliary control unit.

This arrangement makes it possible to check the integrity of the installation in different manners. Thus a known limited power may be injected through the auxiliary control input. The measurement of the fraction restored on each of the optical outputs can then be compared with the predicted calculation in order to carry out a first check.

Conversely, the measurement may be made by injecting a known power starting from the supposedly defective end of the line, possibly using conventional reflectrometry equipment facing the auxiliary input. A fault can then be located since each line is independent in the direction working from its end towards the control unit 10.

The auxiliary control input may also be used by the operator connecting the pyrotechnic initiators 12, to check that he is using the right line, simply by displaying a light source 36 (FIG. 2) placed facing the auxiliary control input and chosen in the visible range.

Furthermore, each control unit 10 is provided with a secondary optical input 40, and feedback means for directing an additional laser beam towards the input of the optical divider coupler 22 through the adapter lens 30, in the case in which the laser source 16 in this control unit is defective.

As shown diagrammatically in FIG. 2, the secondary optical input 40 is provided with an appropriate adapter lens and feedback means comprising a fixed feedback device such as a mirror 42, and a mobile feedback device such as a mirror 44.

The mobile feedback device 44 is controlled by a motor 46 that moves it between a retracted passive position (FIG. 2) and an active position. In the active position, the mobile feedback device 44 directs the supplementary laser beam which enters the control unit 10 through its secondary input 40, towards the input of the optical divider coupler 22. More precisely, the supplementary laser beam entering into the control unit 10 through the secondary input 40 is returned by the fixed feedback device 42 to the mobile feedback device 44 and the mobile feedback device is inserted between the output from laser source 16 and the retractable shutter 32 when it is placed in its active position.

The entire installation also comprises an additional source 48 (FIG. 1) common to all groups, and which may be used during firing if the laser source 16 of one of the control unit 10 is defective. Consequently, an additional laser source 48 is placed facing the secondary optical input 40 of the corresponding control unit 10.

Figure 3:
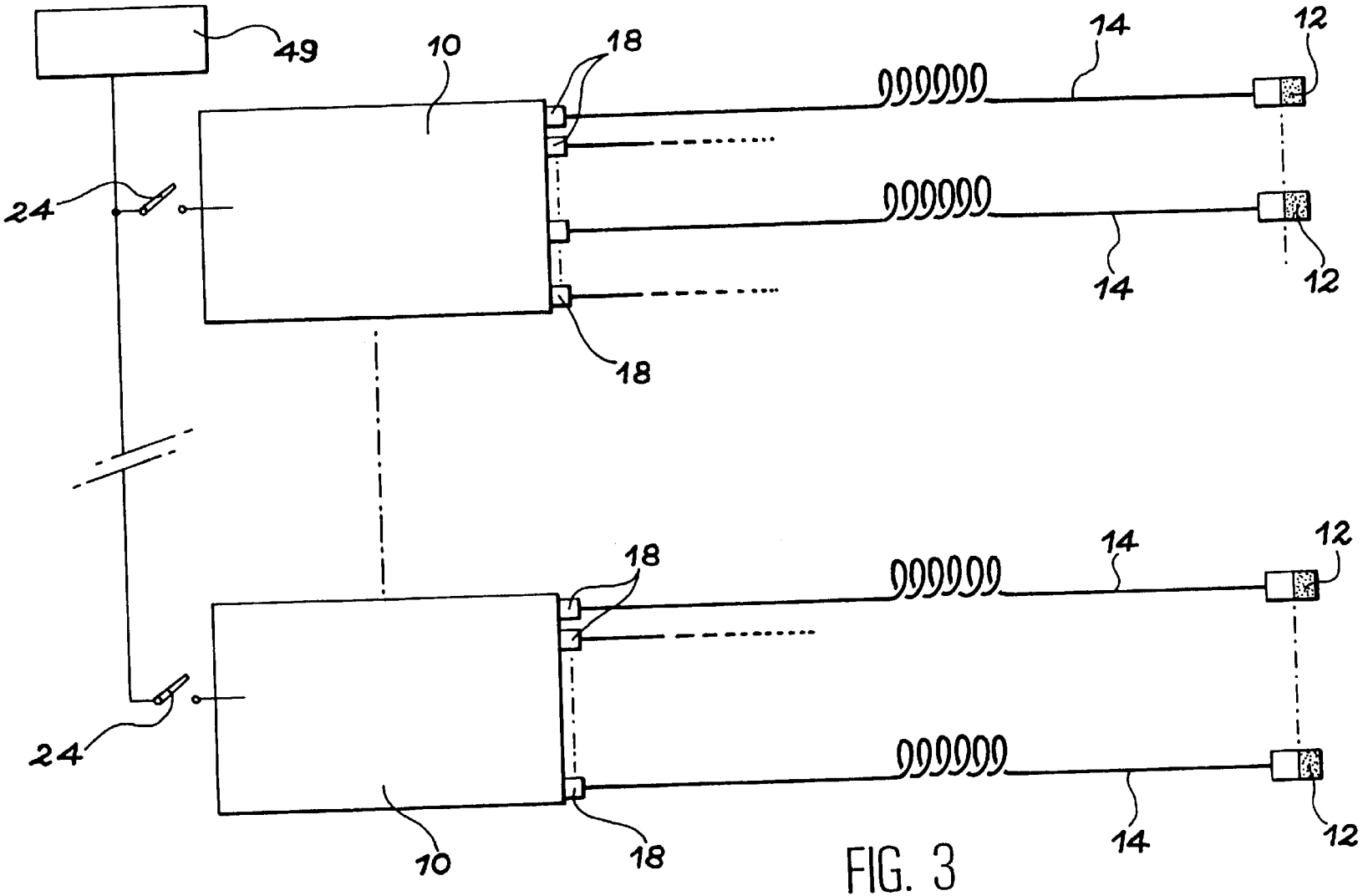
FIG. 3 is a diagrammatic view comparable to FIG. 1, illustrating a second embodiment of the present invention.
Figure 4:
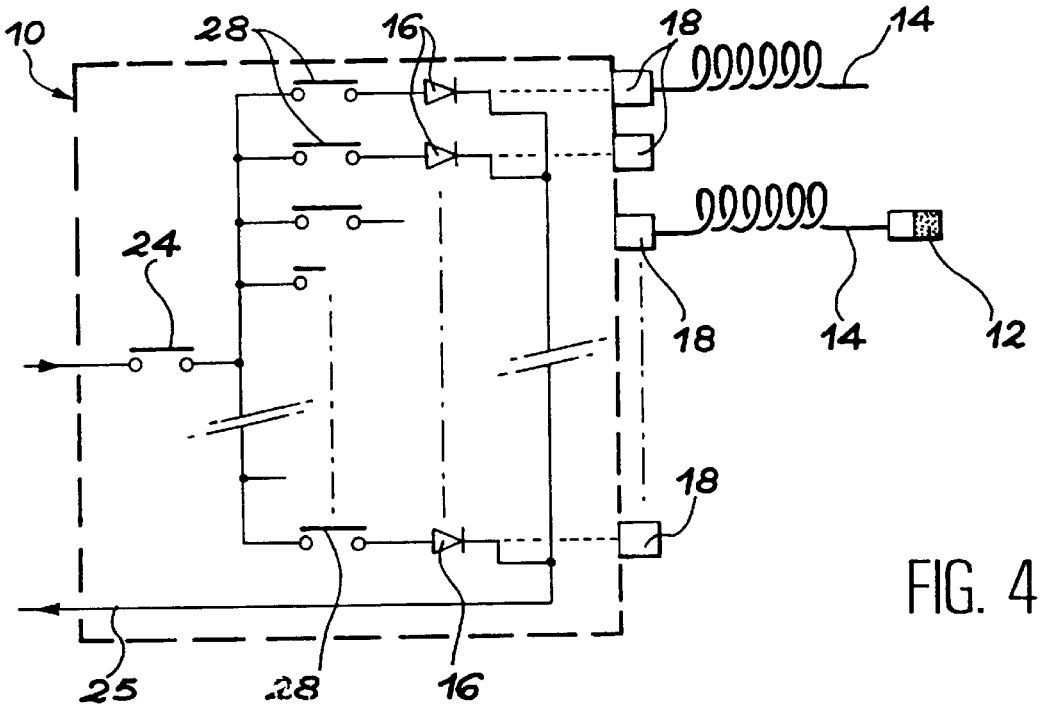
FIG. 4 is a view that diagrammatically shows a first possible construction of the control unit in the installation in FIG. 3.
Figure 5:
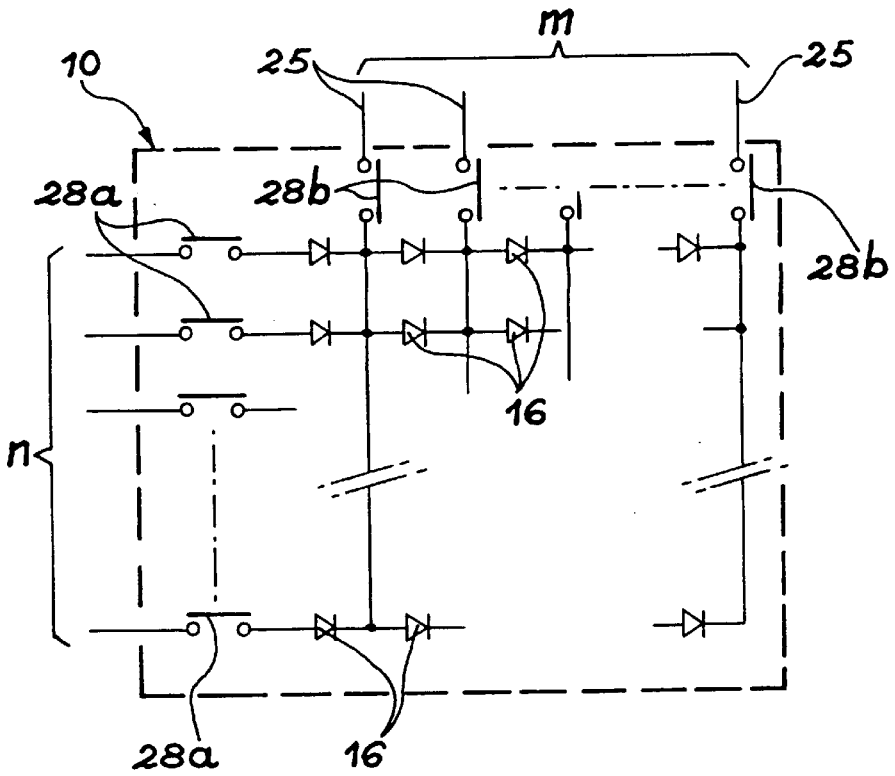
FIG. 5 is a view comparable to FIG. 4, diagrammatically illustrating a variant of the second embodiment of the control unit used in the installation in FIG. 3.

We will now describe a second embodiment of the present invention with reference to FIGS. 3 to 5.

This second embodiment is distinguished from the first embodiment mainly by the nature of the laser sources, which are composed of laser diodes 16. Since the power and energy output by a laser diode are significantly lower than the power and energy output by a laser source with a pumped solid rod as used in the first embodiment described above, in this case a distinct laser source is used for each pyrotechnic initiator 12, and there is no need for optical divider couplers.

As illustrated in FIG. 3, the general architecture of the installation remains very similar to that described previously with reference to FIG. 1. Thus, the installation consists of a number of independent groups each including a control unit 10 with several outputs 18, pyrotechnic initiators 12, and optical fibers 14 connecting the outputs 18 of each control unit to pyrotechnic initiators 12. More precisely, in this case the number of outputs 18 is equal to the number of pyrotechnic initiators 12, and an optical fiber 14 individually connects each output 18 to one of the pyrotechnic initiators 12.

In the basic solution used in the second embodiment of the present invention illustrated in FIG. 4, each control unit 10 comprises one laser diode 16 for each output 18, the laser beam output from each diode being directed towards the corresponding output. Furthermore, all these diodes 16 are installed to be electrically in parallel in an electric power supply circuit designed to be connected to an external low voltage electric power supply source 49 illustrated in in FIG. 3.

More precisely, a control switch 28 is installed in series on each of the laser diodes 16, on the input side of these diodes. In other words, if the number of outputs 18 of the control unit 10 is denoted N, the electric circuit comprises N parallel arms including a control switch 28 and a laser diode 16 in sequence. All these arms inside each control unit 10 are connected to a common power supply line that comprises a safety switch 24. On the output side, the various parallel arms are connected to return line 25 that loops the circuit to the low voltage electric power supply source 49.

For each laser diode 16 considered individually, the safety switch 24, the control switch 28 corresponding to this diode and the laser diode itself are installed in series.

In the architecture illustrated in FIG. 4, each laser diode 16 can be controlled independently by a separate control switch 28. Therefore, there is one control switch for each pyrotechnic initiator 12 to be controlled. This has the advantage of enabling the control of firings without any restrictions.

FIG. 5 shows a variant of the second embodiment of the present invention, by which the number of the control switches 28 may be reduced. In this case, each control unit 10 then includes one laser diode 16 for each output 18. However, instead of being installed on separate parallel arms in the electric circuit, the laser diodes 16 are electrically connected to each other to form a matrix consisting of n rows and m columns.

More precisely, the laser diodes 16 on each line are installed in series with a first control switch 28*a* and the outputs of the laser diodes 16 in each column are connected together and are connected to a return line 25 in which a second control switch 28*b* is installed.

In this arrangement, the laser diodes 16 in the leftmost column can be controlled individually by closing the switch 28*a* on the corresponding line and the switch 28*b* connected to the output from this column. On the other hand, it is impossible to individually control laser diodes 16 located in the other columns. Thus, the only way to control any laser diode in the matrix is to simultaneously control all laser diodes located on the same row and before it. In other words, to the left of the laser diode considered in FIG. 5.

The arrangement that has been described above with reference to FIG. 5 may significantly reduce the number of control switches, since instead of being equal to the total number of diodes (for example about 100 for each group), it is equal to the sum of the number of rows and the number of columns in the laser diode matrix (for example about 20).

In the second embodiment that has just been described with reference to FIGS. 3 to 5, a failure in any of the lines may be detected from the end of the line, by means of conventional inspection devices (reflectrometry, echometry).

What is claimed is:

1. A demolition installation comprising:

at least two independent groups of demolition installation components, each including:

a control unit including several outputs, a single laser source for each of said several outputs, and at least one control switch for each of said laser sources, said laser sources being a pumped solid rod operating in a relaxed mode such that closure of said control switches will cause said laser sources to emit a first laser beam for at least one of said several outputs;

optically controlled pyrotechnic initiators placed at determined locations in a structure to be demolished;

optical fibers connecting each of said pyrotechnic initiators to one of said several outputs of said control unit;

a first optical divider coupler receiving a primary optical input, in a form of said first laser beam, emitted by said laser sources;

a secondary optical input directing a second laser beam to penetrate said control unit; and first feedback means configured to direct said second laser beam from said secondary optical input to said primary optical input of said first optical divider coupler for said control unit; and an additional laser source common to all of said at least two independent groups, said additional laser source emitting said second laser beam to said secondary optical input.

2. The demolition installation according to claim 1, further comprising at least some optical fibers in each group connecting several of said pyrotechnic initiators to one of said several outputs of said control unit through at least one second optical divider coupler.

3. The demolition installation according to claim 1, wherein each control unit includes both an auxiliary control input and a second feedback means, said second feedback means configured to set up a bypass optical path between said auxiliary control input and said primary optical input to said first optical divider coupler in said control unit.

4. The demolition installation according to claim 3, wherein each control unit includes a retractable shutter retractably located between said laser sources and said primary optical input to said first optical divider coupler.

5. The demolition installation according to claim 4, wherein said second feedback means is an inclined reflecting face of said retractable shutter, said second feedback means only providing feedback when said retractable shutter is in an active closed position.

6. The demolition installation according to claim 1, wherein each of said control units include a safety switch installed in series with said control switches.

7. A demolition installation comprising:

at least two independent groups of demolition installation components, each including:

a control unit having several outputs, at least one laser diode for each of said several outputs, and at least one control switch for each of said at least one laser diode, each of said laser diodes being optically connected to one of said several outputs and each of said laser diodes being installed in series with said control switches such that closure of said control switches will cause said laser diodes to emit a first laser beam toward each of said several outputs;

optically controlled pyrotechnic initiators placed at determined locations in a structure to be demolished;

optical fibers connecting each of said pyrotechnic initiators to one of said several outputs of said control unit.

8. A demolition installation comprising:

at least two independent groups of demolition installation components, each including:

a control unit having several outputs, a laser diode for each of said several outputs, and at least one control switch for each of said laser diodes, said laser diodes being optically connected to one of said several outputs so that closure of said control switches will cause said laser diodes to emit a first laser beam toward at least one of said several outputs;

optically controlled pyrotechnic initiators placed at determined locations in a structure to be demolished; and optical fibers connecting each of said pyrotechnic initiators to one of said several outputs of said control unit; and a common safety switch installed in series with all of said laser diodes in each of said control units.

9. A demolition installation comprising:

at least two independent groups of demolition installation components, each including:

a control unit having several outputs, a single laser diode for each output of said several outputs, and at least one control switch for each of said laser diodes, each of said laser diodes being optically connected to one of said several outputs, such that closure of said control switches will cause each of said laser diodes to emit a first laser beam toward at least one of said several outputs, and wherein said laser diodes form a matrix of a variable number of rows and columns, said laser diodes in each row being installed in series with a first control switch and outputs of said laser diodes in each column being connected to a second control switch;

optically controlled pyrotechnic initiators placed at determined locations in a structure to be demolished; and optical fibers connecting each of said pyrotechnic initiators to one of said several outputs of said control unit.

* * * * *